US007748978B2

(12) United States Patent
Bao et al.

(10) Patent No.: US 7,748,978 B2
(45) Date of Patent: Jul. 6, 2010

(54) PIEZOELECTRIC LIGHTER

(76) Inventors: Fan Bao, 236 S. 8th Ave., Suite D, City of Industry, CA (US) 91746; Xi Zhong An, Wenzhou Xinqiao Gaoxiang Industrial Zone, No. 2 Gao Ge Lu Wenzhou, Zhejiang (CN)

( * ) Notice: Subject to any disclaimer, the term of this patent is extended or adjusted under 35 U.S.C. 154(b) by 982 days.

(21) Appl. No.: 11/511,567

(22) Filed: Aug. 28, 2006

(65) Prior Publication Data

US 2008/0050685 A1 Feb. 28, 2008

(51) Int. Cl.
*F23Q 2/16* (2006.01)

(52) U.S. Cl. ..... 431/255; 431/278; 431/279; 431/281

(58) Field of Classification Search ..... 431/255, 431/278–285
See application file for complete search history.

(56) References Cited

U.S. PATENT DOCUMENTS

| | | | | | |
|---|---|---|---|---|---|
| 1,894,300 | A * | 1/1933 | Barker | 431/230 |
| 2,430,323 | A * | 11/1947 | Ayotte | 431/276 |
| 2,914,060 | A * | 11/1959 | Wilcox | 126/208 |
| 3,174,310 | A * | 3/1965 | Genoud | 431/277 |
| 3,253,430 | A * | 5/1966 | Piffath | 431/277 |
| 3,309,902 | A * | 3/1967 | Kanamaru | 431/277 |
| 3,488,135 | A * | 1/1970 | Quercia | 431/254 |
| 4,458,667 | A * | 7/1984 | Hsieh | 126/208 |
| 4,874,263 | A | 10/1989 | McCall et al. | |
| 5,067,214 | A | 11/1991 | Hosmer et al. | |
| 5,310,336 | A * | 5/1994 | Segawa | 431/131 |
| 5,542,269 | A | 8/1996 | Richards | |
| 6,055,711 | A | 5/2000 | Weil et al. | |
| 6,589,045 | B2 * | 7/2003 | Xu | 431/255 |
| 6,773,258 | B1 * | 8/2004 | Wong | 431/142 |
| 6,884,063 | B2 * | 4/2005 | Wong | 431/255 |
| 7,335,017 | B2 * | 2/2008 | Wong et al. | 431/277 |
| 2002/0123017 | A1 * | 9/2002 | Xu | 431/153 |
| 2003/0114063 | A1 | 6/2003 | Weil et al. | |
| 2004/0209213 | A1 * | 10/2004 | Wong | 431/255 |
| 2007/0254253 | A1 * | 11/2007 | Wu | 431/254 |

FOREIGN PATENT DOCUMENTS

WO WO 2005/100860 * 10/2005

* cited by examiner

*Primary Examiner*—Carl D Price
(74) *Attorney, Agent, or Firm*—Raymond Y. Chan; David and Raymond Patent Firm

(57) ABSTRACT

A piezoelectric lighter includes a lighter housing having a fuel storage chamber for storing liquefied gas therewithin, a gas releasing valve and a dual ignition arrangement adapted for generating two flames. The dual ignition arrangement includes second and second nozzles spacedly supported at the lighter housing, second and second piezoelectric units spacedly received in the lighter housing, and second and second actuators spacedly and movably mounted on the lighter housing. The second actuator is supported on top of the second piezoelectric unit to depress the second depressible part thereof for producing the second flame, wherein the second actuator is supported on top of the second piezoelectric unit to depress the second depressible part thereof for producing the second flame, such that the lighter is adapted for selectively producing the second and second flames via the second and second actuators respectively.

20 Claims, 4 Drawing Sheets

PIEZOELECTRIC LIGHTER

BACKGROUND OF THE PRESENT INVENTION

1. Field of Invention

The present invention relates to a lighter, and more particularly to a piezoelectric lighter comprising a dual ignition arrangement which is capable of generating two flames in two different orientations.

2. Description of Related Arts

A convention lighter usually comprises a lighter casing, a fuel storage chamber storing a predetermined amount of liquefied fuel, a gas releasing nozzle extended from the fuel storage chamber, a piezoelectric unit comprising a movable part and a generating tip for generating a spark when the movable part is depressed, and an actuation button communicated with the piezoelectric unit in such a manner that when the actuation button is depressed, a spark will be generated at the spark generating tip while the gas releasing nozzle is uplifted to release the liquefied gas for producing a flame at a predetermined nozzle opening formed on the lighter casing. Thus, one may appreciate that conventional lighter usually utilizes one piezoelectric unit to produce flame at one gas releasing nozzle.

The disadvantage of this conventional lighter is that it is inconvenient to use in some situations. First, the gas releasing nozzle is usually fixed on the lighter casing at a predetermined position so that the flame produced at the gas releasing nozzle is oriented in a single predetermined direction. As a result, when different orientation of the flame is desired, conventional lighter can hardly satisfy the underlying situation. In many occasions, one has to tilt the orientation of the lighter casing in order to generate a flame having a particular orientation.

Moreover, if a lighter, such as the conventional lighter, has only one single gas releasing nozzle, that lighter could only produce flame of a predetermined kind, such as a windproof flame or a regular flame. As a result, the lighter, such as the conventional lighter, may not fit for different environment situations so that its use tends to be inflexible. For example, a regular frame may not survive under a windy environment, while a windproof frame may not be desirable for older people having worse vision because the flame is usually colorless.

SUMMARY OF THE PRESENT INVENTION

A main object of the present invention is to provide a piezoelectric lighter which comprises a dual ignition arrangement which is capable of generating two flames in two different orientations.

Another object of the present invention is to provide a piezoelectric lighter comprising a dual ignition arrangement, which is adapted to produce two different kinds of flames at two different gas releasing nozzles respectively. A user is able to select the most desirable flame depending upon the environment in which the piezoelectric lighter is utilized.

Another object of the present invention is to provide a piezoelectric lighter comprising a dual ignition arrangement, wherein two gas releasing nozzles are served by one single fuel storage chamber and two piezoelectric units for selectively producing two different flames. As a result, an overall size of the present invention can be minimized by not utilizing two different fuel storage chambers to produce two flames.

Another object of the present invention is to provide a piezoelectric lighter comprising a dual ignition arrangement which does not involve complicated mechanical structures or expensive components so as to minimize the manufacturing cost of the present invention.

Accordingly, in order to accomplish the above objects, the present invention provides a piezoelectric lighter, comprising:

a lighter housing having a fuel storage chamber for storing liquefied gas therewithin;

a gas releasing valve communicating the fuel storage chamber for releasing the gas in a controllable manner; and a dual ignition arrangement, adapted for generating two flames, which comprises:

first and second nozzles spacedly supported at the lighter housing, wherein the first and second nozzles are communicatively extended from the gas releasing valve for emitting the gas through the first and second nozzles;

first and second piezoelectric units spacedly received in the lighter housing, wherein the first piezoelectric unit comprises a first depressible part and a first spark generation tip extending towards the first ignition nozzle for igniting the gas thereat to produce the first flame, wherein the second piezoelectric unit comprises a second depressible part and a second spark generation tip extending towards the second ignition nozzle for igniting the gas thereat to producing the second flame; and first and second actuators spacedly and movably mounted on the lighter housing, wherein the first actuator is supported on top of the first piezoelectric unit to depress the first depressible part thereof for producing the first flame, wherein the second actuator is supported on top of the second piezoelectric unit to depress the second depressible part thereof for producing the second flame, such that the lighter is adapted for selectively producing the first and second flames via the first and second actuators respectively.

These and other objectives, features, and advantages of the present invention will become apparent from the following detailed description, the accompanying drawings, and the appended claims.

DETAILED DESCRIPTION OF THE PREFERRED EMBODIMENT

Figure 1:
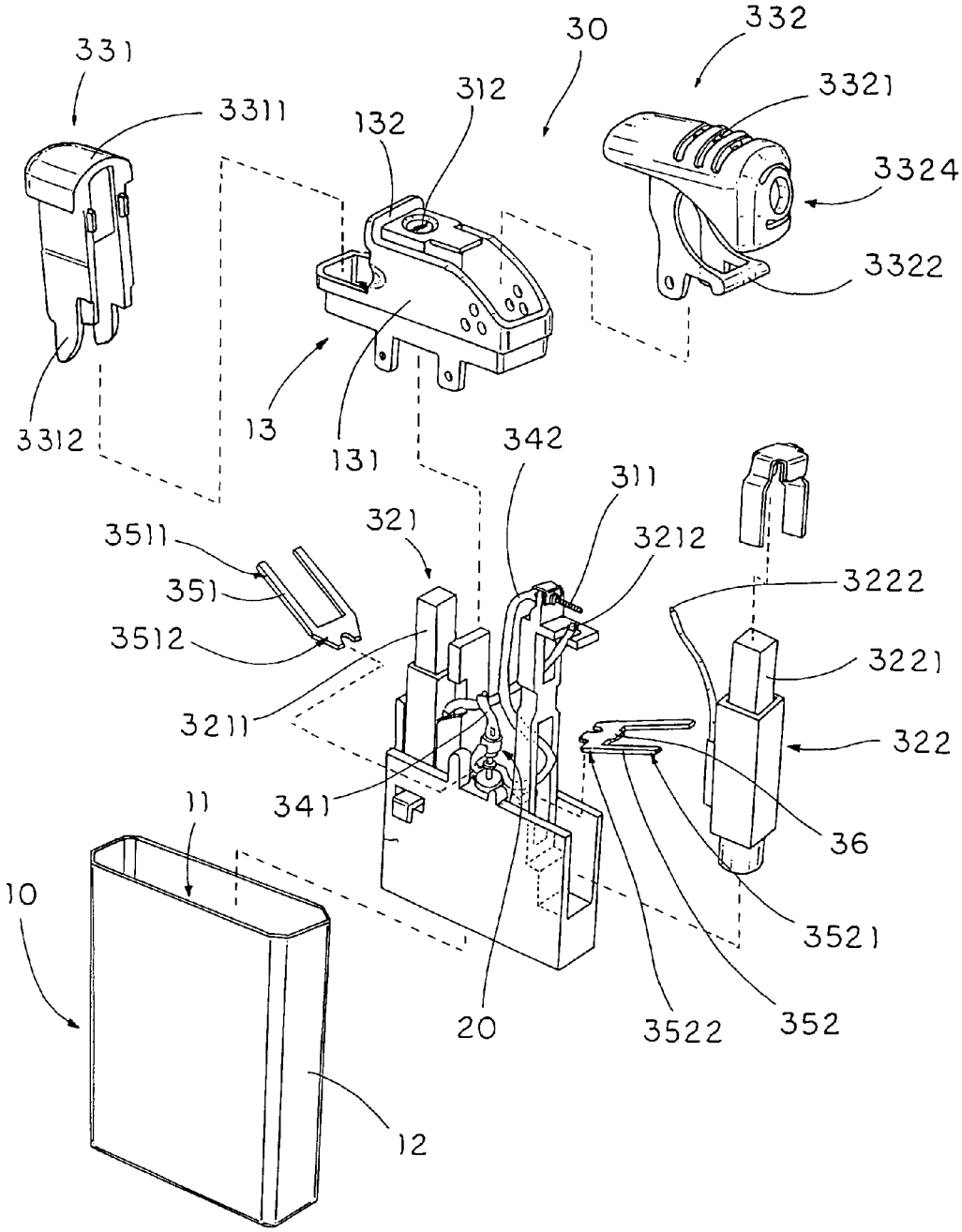
FIG. 1 is an exploded perspective view of a piezoelectric lighter according to a preferred embodiment of the present invention.

Referring to FIG. 1, FIG. 2, FIG. 3A and FIG. 3B of the drawings, a piezoelectric lighter according to a preferred embodiment of the present invention is illustrated, in which the piezoelectric lighter comprises a lighter housing 10 having a fuel storage chamber 11 for storing liquefied gas therewithin, a gas releasing valve 20 communicating the fuel storage chamber 11 for releasing the gas stored therein in a controllable manner, and a dual ignition arrangement 30.

The dual ignition arrangement 30 is adapted for generating two flames, and comprises first and second nozzles 311, 312, first and second piezoelectric units 321, 322, and first and second actuators 331, 332.

The first and the second nozzles 311, 312 are spacedly supported at the lighter housing 10, wherein the first and second nozzles 311, 312 are communicatively extended from the gas releasing valve 20 for emitting the gas through the first and the second nozzles 311, 312.

The first and the second piezoelectric units 321, 322 are spacedly received in the lighter housing 10, wherein the first piezoelectric unit 321 comprises a first depressible part 3211 and a first spark generation tip 3212 extending towards the first ignition nozzle 311 for igniting the gas thereat to produce the first flame, wherein the second piezoelectric unit 322 comprises a second depressible part 3221 and a second spark generation tip 3222 extending towards the second ignition nozzle 322 for igniting the gas thereat to producing the second flame.

The first and the second actuators 331, 332 are spacedly and movably mounted on the lighter housing 10, wherein the first actuator 331 is supported on top of the first piezoelectric unit 321 to depress the first depressible part 3211 thereof for producing the first flame, wherein the second actuator 332 is supported on top of the second piezoelectric unit 322 to depress the second depressible part 3221 thereof for producing the second flame, such that the lighter is adapted for selectively producing the first and second flames via the first and second actuators 331, 332 respectively.

According to the preferred embodiment of the present invention, the lighter housing 10 comprises a lower lighter casing 12 for receiving the fuel storage chamber 11, and the first and the second piezoelectric units 321, 322, and an upper supporting frame 13 provided on top of the lower lighter casing 12 for operatively supporting the first and the second actuators 331, 332, and the first and the second nozzles 311, 312 for facilitating production of the two flames upon actuation of the first and the second actuators 331, 332.

The gas releasing valve 20 is operatively provided on the fuel storage chamber 11 in such a manner that when the gas releasing valve 20 is uplifted, the liquefied gas stored inside the fuel storage chamber 11 will be controllably released to the first and the second nozzles 311, 312 for generating the flame at the selected nozzle 311, 312. As a result, the dual ignition arrangement 30 further comprises second and first guiding tubes 342, 341 spacedly extended from the gas releasing valve 20 to the first and second nozzles 311, 312 respectively, such that when the gas releasing valve 20 is actuated for releasing the gas from the fuel storage chamber 11, the gas is directed to the second and the first nozzles 312, 311 through the second and first guiding tubes 342, 341 respectively for being ignited when one of the second and the first actuators 332, 331 is selectively actuated.

The second and first guiding tubes 342, 341 are two flexible tubes, wherein the dual ignition arrangement further comprises a gas stopper 36 which is movably supported in the lighter housing 10 at a position close to second guiding tube 342 and is arranged when the first actuator 331 is actuated, the gas stopper 36 is moved to press against the second guiding tube 342 for blocking the gas passing therethrough so as to maximize the gas passing through the first guiding tube 341 to the second nozzle 312.

The first and the second piezoelectric units 321, 322 are spacedly provided at two side portions of the lighter casing 12 for aligning with the corresponding actuators 331, 332 of the dual ignition arrangement 30. Accordingly, the first and the second actuators 331, 332 are aligned on top of the depressible parts 3211 of the piezoelectric units 321, 322 respectively for igniting the piezoelectric lighter at the corresponding nozzles 311 (312).

Figure 2:
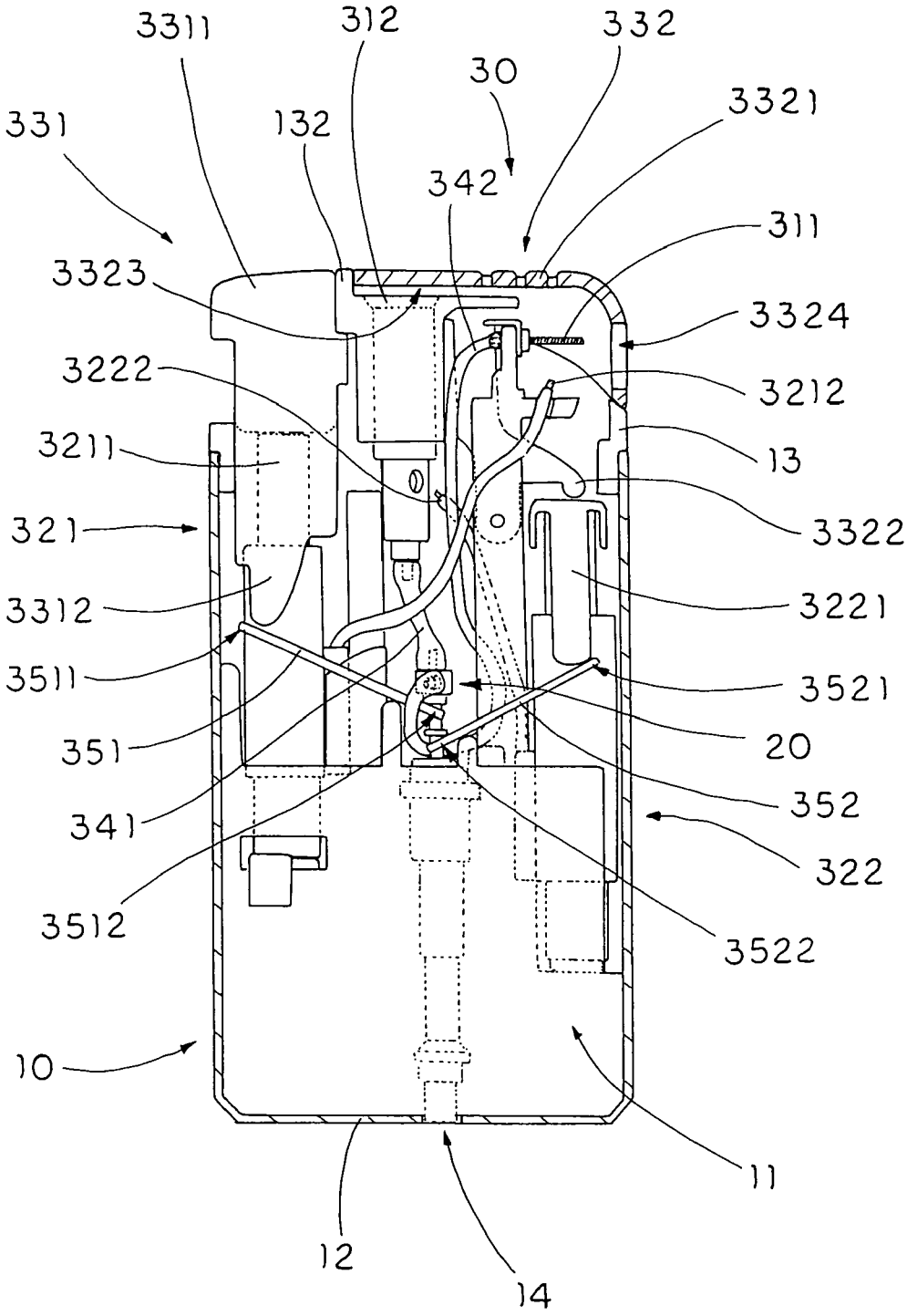
FIG. 2 is a section side view of the piezoelectric lighter according to the above preferred embodiment of the present invention.
Figure 3A:
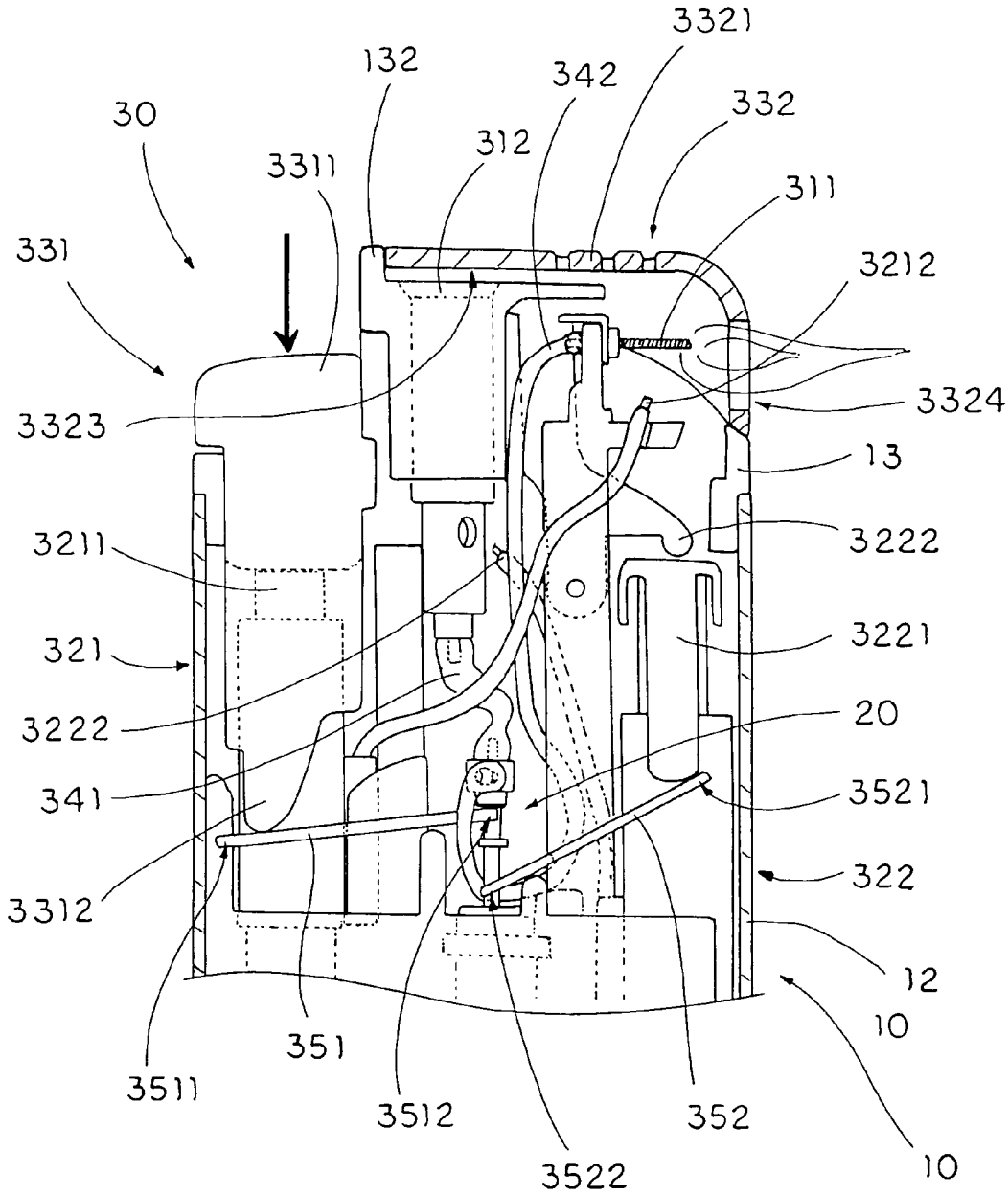
FIG. 3A and FIG. 3B are schematic diagrams of the piezoelectric lighter according to the above preferred embodiment of the present invention.
Figure 3B:
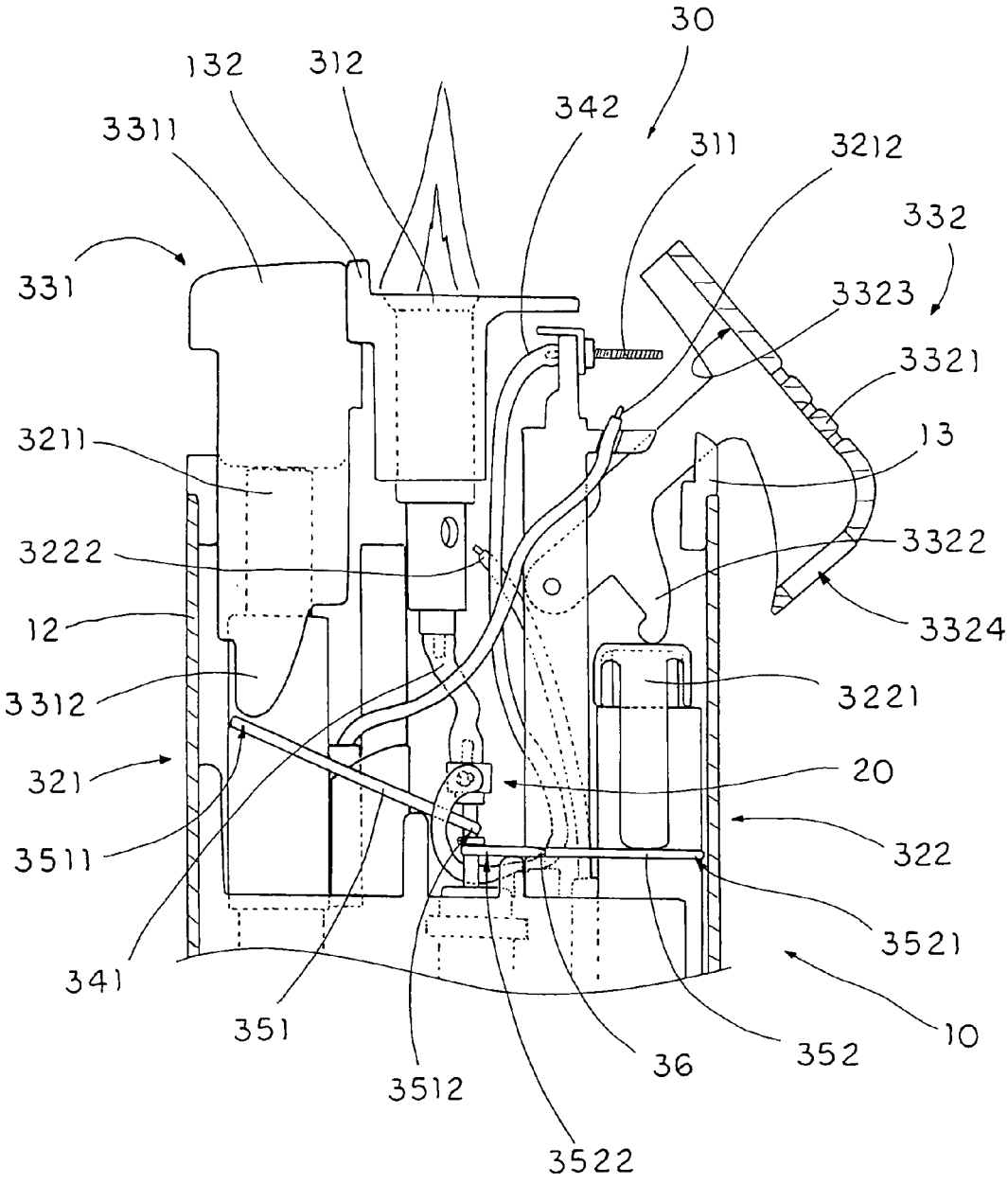

Referring to FIG. 1 to FIG. 2 of the drawings, the first actuator 331 comprises an actuation button 3311 slidably mounted on a left side portion of the supporting frame 13 of the lighter housing 10, and a depressing member 3312 integrally extended from a bottom portion of the actuation button 3311 for aligning with the first depressible part 3211 of the first piezoelectric unit 321. Accordingly, when the actuation button 3311 is downwardly depressed, the depressing member 3312 is depressed as well for depressing the first depressible part 3211 of the first piezoelectric unit 321 so as to generate a spark at the first spark generating tip 3212.

On the other hand, the second actuator 332, having a flame outlet aligning with an opening of the first nozzle 311, comprises a flame cover 3321 pivotally provided at a right side portion of the upper supporting frame 13 of the lighter housing 10 in a radially movable manner, and a pivotal pushing member 3322 downwardly extended from the flame cover 3321 to align with the second depressible part 3221 of the second piezoelectric unit 322, in such a manner that when the flame cover 3321 is pivotally actuated, the pivotal pushing member 3322 is pivotally driven to depress the second depressible part 3221 of the second piezoelectric unit 322 for generating a spark at the second spark generating tip 3222.

Thus, the flame cover 3321 extends above the upper supporting frame 13 to normally cover an opening of the second nozzle 312 such that when the second actuator 332 is radially and pivotally depressed to actuate the second piezoelectric unit 322, the flame cover 3321 is driven to move away from the supporting frame 13 to expose the opening of the second nozzle 312.

The dual ignition arrangement 30 further comprises a first and a second lever 351, 352 operatively mounted in the lighter casing 11 of the lighter housing 10 for converting a downward movement of the depressible parts 3211, 3221 of the piezoelectric units 321, 322 into an uplifting movement of the gas releasing valve 20 so as to allow release of the liquefied gaseous fuel stored in the fuel storage chamber 11.

In other words, the second and first levers 352, 351 are spacedly and pivotally supported in the lighter housing 10, wherein the second lever 352 is pivotally coupling between the second actuator 332 and the gas releasing valve 20 to actuate the gas releasing valve 20 for releasing the gas when the second actuator 332 is actuated, wherein the first lever 351 is pivotally coupling between the first actuator 331 and the gas releasing valve 20 to actuate the gas releasing valve 20 for releasing the gas when the first actuator 331 is actuated.

More specifically, the first lever 351 has a first depressible end 3511 connected at the first depressible part 3211 of the first piezoelectric unit 321, and a first uplifting end 3512 connected to the gas releasing valve 20 so that when the first depressible part 3211 is depressed, the first depressible end 3511 of the first lever 351 is depressed as well and as a result the first uplifting end 3512 of the first lever 351 is uplifted to release the liquefied fuel to the first nozzle 311.

Likewise, the second lever 352 has a second depressible end 3521 connected at the second depressible part 3221 of the second piezoelectric unit 322, and a second uplifting end 3522 connected to the gas releasing valve 20 so that when the second depressible part 3221 is depressed, the second depressible end 3521 of the second lever 352 is depressed as well and as a result the second uplifting end 3522 of the second lever 352 is uplifted to release the liquefied fuel to the second nozzle 311.

The gas stopper 36 is integrally formed at the second lever 352 towards the second guiding tube 342 such that when the second lever 352 is pivotally moved to open the gas releasing valve 20, the gas stopper 36 is driven to press against the second guiding tube 342 to block the gas passing therethrough.

According to the preferred embodiment of the present invention, each of the first and the second nozzles 311, 312 are adapted to ignite flames of different kinds, and having different orientations. The first nozzle 311 is transversely extended at an opposite side to the first actuator 331 on the lighter housing 10 so as to produce a flame which points sidewardly with respect to the lighter housing 10. On the other hand, the second nozzle 312 is provided at the supporting frame 13 and is facing upwardly for producing a windproof flame in an upward orientation with respect to the lighter housing 10.

In other words, the second nozzle 312 is a torch nozzle to produce a windproof flame as the second flame and the first nozzle 311 is a gas nozzle to produce a gas flame as the first flame, such that the second and first nozzles 312, 311 are adapted to produce different types of flame in different orientations.

It is worth mentioning that the flame cover 3321 of the second actuator 332 has a substantial triangular cross section and defines a button cavity therewithin, wherein the second nozzle 312 is aligned right under a top ceiling 3323 of the flame cover 3321, in such a manner that the second nozzle 312 is normally covered by this top ceiling 3323, and when the second actuator 332 is pivotally actuated to ignite the piezoelectric lighter, the top ceiling 3323 is pivotally and sidewardly move to expose the second nozzle 312 to an exterior of the piezoelectric lighter so as to allow the windproof flame produced at the second nozzle 312 to ignite a desired object, such as a cigarette without interference caused by the top ceiling 3323 of the second actuator 332.

Accordingly, one should appreciate that the second actuator 332 further has a second flame outlet 3324 formed at a sidewall of the second actuator 332 to align with the first nozzle 311 supported by the supporting frame 13, such that when the first actuator 331 is actuated, the resulting flame produced at the first nozzle 311 is allowed to sidewardly reach an exterior of the lighter housing 10 via the second flame outlet 3324.

The supporting frame 13 of the lighter housing 10 comprises a frame body 131 mounted on the lighter casing 12, and a partitioning sidewall 132 upwardly extended at the frame body 131 to divide the frame body 131 into a first and a second button compartments, wherein the first and the second actuator 331, 332 are operatively received in the first and the second button compartments respectively for selectively igniting the piezoelectric lighter of the present invention.

The lighter housing 10 further comprises a gas refueling inlet 14 provided at a bottom side of the lighter housing 10 for refilling the liquefied gaseous fuel of the piezoelectric lighter of the present invention.

The operation of the present invention is as follows: the user is able to select which actuator 331 (332) he or she would like to utilize. If the user wishes to have a windproof flame, he or she needs only to pivotally actuate the second actuator 332 for depressing the second depressible part 3221 of the second piezoelectric unit 322 for igniting a windproof flame at the second nozzle 312. Conversely, if the user wishes to have a regular flame, he or she needs only to depress the first actuator 331 for depressing the first depressible part 3211 of the first piezoelectric unit 321 for igniting a regular flame at the first nozzle 311. As a result, the user is able to select a suitable flame type and orientation depending upon the environment in which the piezoelectric lighter is utilized.

It is worth mentioning that as an alternative of the present invention, there may have two fuel storage chambers each of which is arranged to supply to fuel for igniting the respective flame at the respective nozzles 311, 312.

Moreover, one may appreciate that the second and first piezoelectric units 322, 321 are supported at two side portions of the lighter housing 10 respectively at a position that the gas releasing valve 20 is positioned between the second and first piezoelectric units 322, 321 so as to form a compact structure of the piezoelectric lighter with the dual ignition arrangement 30.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A piezoelectric lighter, comprising:

a lighter housing comprising a supporting frame and having a fuel storage chamber for storing liquefied gas therewithin;

a gas releasing valve communicating said fuel storage chamber for releasing said gas in a controllable manner; and a dual ignition arrangement, adapted for generating two flames, which comprises:

first and second nozzles spacedly supported at said supporting frame of said lighter housing, wherein said first and second nozzles are communicatively extended from said gas releasing valve for emitting said gas through said first and second nozzles;

first and second piezoelectric units spacedly received in said lighter housing, wherein said first piezoelectric unit comprises a first depressible part and a first spark generation tip extending towards said first ignition nozzle for igniting said gas thereat to produce said first flame, wherein said second piezoelectric unit comprises a second depressible part and a second spark generation tip extending towards said second ignition nozzle for igniting said gas thereat to producing said second flame;

first and second actuators spacedly and movably mounted on said lighter housing, wherein said first actuator is supported on top of said first piezoelectric unit to depress said first depressible part thereof for producing said first flame, wherein said second actuator is supported on top of said second piezoelectric unit to depress said second depressible part thereof for producing said second flame, such that said lighter is adapted for selectively producing said first and second flames via said first and second actuators respectively, wherein said second actuator, having a flame outlet aligning with an opening of said first nozzle, is pivotally mounted on said supporting frame in a radially movable manner to depress said second piezoelectric unit so as to produce said second flame when said second actuator is radially and pivotally depressed, wherein said first actuator is slidably mounted on said supporting frame in a vertically movable manner to depress said first piezoelectric unit so as to produce said first flame through said flame outlet when said first actuator is downwardly depressed, such that said second actuator forms a flame windshield when said second actuator is depressed to produce said second flame; and means for communicating said gas releasing valve with said first and said second actuator in such a manner when one of said first and said second actuator is actuated, said gas releasing valve is arranged to release said gas for igniting one of said first flame and said second flame.

2. The piezoelectric lighter, as recited in claim 1, wherein said second nozzle is longitudinally extended at said supporting frame to produce said second flame in a longitudinal direction with respective to said piezoelectric light, and said first nozzle is transversely extended at said supporting frame to produce said first flame in a transverse direction with respective to said piezoelectric lighter, such that said second and first nozzles are adapted to produce said second and first flames in different directions.

3. The piezoelectric lighter, as recited in claim 2, wherein said second nozzle is a torch nozzle to produce a windproof flame as said second flame and said first nozzle is a gas nozzle to produce a gas flame as said first flame, such that said second and first nozzles are adapted to produce different types of flame.

4. The piezoelectric lighter, as recited in claim 3, wherein said second actuator comprises a flame cover extended above said supporting frame to normally cover an opening of said second nozzle such that when said second actuator radially and pivotally depressed to actuate said second piezoelectric unit, said flame cover is driven to move away from said supporting frame to expose said opening of said second nozzle.

5. The piezoelectric lighter, as recited in claim 4, wherein said dual ignition arrangement further comprises second and first guiding tubes spacedly extended from said gas releasing valve to said second and first nozzles respectively, such that when said gas releasing valve is actuated for releasing said gas from said fuel storage chamber, said gas is directed to said second and said first nozzles through said second and first guiding tubes respectively for being ignited when one of said second and first actuators is selectively actuated.

6. The piezoelectric lighter, as recited in claim 5, wherein said second and first guiding tubes are two flexible tubes, wherein said dual ignition arrangement further comprises a gas stopper which is movably supported in said lighter housing at a position close to said second guiding tube and is arranged when said first actuator is actuated, said gas stopper is moved to press against said second guiding tube for blocking said gas passing therethrough so as to maximize said gas passing through said first guiding tube to said second nozzle.

7. The piezoelectric lighter, as recited in claim 6, wherein said means for communicating said gas releasing valve with said first and said second actuator comprises second and first levers spacedly and pivotally supported in said lighter housing, wherein said second lever is pivotally coupling between said second actuator and said gas releasing valve to actuate said gas releasing valve for releasing said gas when said second actuator is actuated, wherein said first lever is pivotally coupling between said first actuator and said gas releasing valve to actuate said gas releasing valve for releasing said gas when said first actuator is actuated.

8. The piezoelectric lighter, as recited in claim 7, wherein said gas stopper is integrally formed at said second lever towards said second guiding tube such that when said first lever is pivotally moved to open said gas releasing valve, said gas stopper is driven to press against said second guiding tube to block said gas passing therethrough.

9. The piezoelectric lighter, as recited in claim 8, wherein said second and first piezoelectric units are supported at two side portions of said lighter housing respectively at a position that said gas releasing valve is positioned between said second and first piezoelectric units so as to form a compact structure of said piezoelectric lighter with said dual ignition arrangement.

10. The piezoelectric lighter, as recited in claim 2, wherein said second actuator comprises a flame cover extended above said supporting frame to normally cover an opening of said second nozzle such that when said second actuator radially and pivotally depressed to actuate said second piezoelectric unit, said flame cover is driven to move away from said supporting frame to expose said opening of said second nozzle.

11. The piezoelectric lighter, as recited in claim 3, wherein said dual ignition arrangement further comprises second and first guiding tubes spacedly extended from said gas releasing valve to said second and first nozzles respectively, such that when said gas releasing valve is actuated for releasing said gas from said fuel storage chamber, said gas is directed to said second and said first nozzles through said second and first guiding tubes respectively for being ignited when one of said second and first actuators is selectively actuated.

12. The piezoelectric lighter, as recited in claim 11, wherein said second and first guiding tubes are two flexible tubes, wherein said dual ignition arrangement further comprises a gas stopper which is movably supported in said lighter housing at a position close to said second guiding tube and is arranged when said first actuator is actuated, said gas stopper is moved to press against said second guiding tube for blocking said gas passing therethrough so as to maximize said gas passing through said first guiding tube to said second nozzle.

13. The piezoelectric lighter, as recited in claim 12, wherein said means for communicating said gas releasing valve with said first and said second actuator comprises second and first levers spacedly and pivotally supported in said lighter housing, wherein said second lever is pivotally coupling between said second actuator and said gas releasing valve to actuate said gas releasing valve for releasing said gas when said second actuator is actuated, wherein said first lever is pivotally coupling between said first actuator and said gas releasing valve to actuate said gas releasing valve for releasing said gas when said first actuator is actuated.

14. The piezoelectric lighter, as recited in claim 13, wherein said gas stopper is integrally formed at said second lever towards said second guiding tube such that when said first lever is pivotally moved to open said gas releasing valve, said gas stopper is driven to press against said second guiding tube to block said gas passing therethrough.

15. The piezoelectric lighter, as recited in claim 14, wherein said second and first piezoelectric units are supported at two side portions of said lighter housing respectively at a position that said gas releasing valve is positioned between said second and first piezoelectric units so as to form a compact structure of said piezoelectric lighter with said dual ignition arrangement.

16. The piezoelectric lighter, as recited in claim 1, wherein said second nozzle is a torch nozzle to produce a windproof flame as said second flame and said first nozzle is a gas nozzle to produce a gas flame as said first flame, such that said second and first nozzles are adapted to produce different types of flame.

17. The piezoelectric lighter, as recited in claim 1, wherein said second actuator comprises a flame cover extended above said supporting frame to normally cover an opening of said second nozzle such that when said second actuator radially and pivotally depressed to actuate said second piezoelectric unit, said flame cover is driven to move away from said supporting frame to expose said opening of said second nozzle.

18. The piezoelectric lighter, as recited in claim 1, wherein said dual ignition arrangement further comprises second and first guiding tubes spacedly extended from said gas releasing valve to said second and first nozzles respectively, such that when said gas releasing valve is actuated for releasing said gas from said fuel storage chamber, said gas is directed to said second and said first nozzles through said second and first guiding tubes respectively for being ignited when one of said second and first actuators is selectively actuated.

19. The piezoelectric lighter, as recited in claim 18, wherein said second and first guiding tubes are two flexible tubes, wherein said dual ignition arrangement further comprises a gas stopper which is movably supported in said lighter housing at a position close to said second guiding tube and is arranged when said first actuator is actuated, said gas stopper is moved to press against said second guiding tube for blocking said gas passing therethrough so as to maximize said gas passing through said first guiding tube to said second nozzle.

20. The piezoelectric lighter, as recited in claim 19, wherein said means for communicating said gas releasing valve with said first and said second actuator comprises second and first levers spacedly and pivotally supported in said lighter housing, wherein said second lever is pivotally coupling between said second actuator and said gas releasing valve to actuate said gas releasing valve for releasing said gas when said second actuator is actuated, wherein said first lever is pivotally coupling between said first actuator and said gas releasing valve to actuate said gas releasing valve for releasing said gas when said first actuator is actuated.

* * * * *